US006059297A

United States Patent [19]

Demarchi

[11] Patent Number: 6,059,297

[45] Date of Patent: May 9, 2000

[54] BRAKING DEVICE FOR ROLLER SKATES

[75] Inventor: Jean-Louis Demarchi, Saint-Jorioz, France

[73] Assignee: Salomon S.A., Metz-Tessy, France

[21] Appl. No.: 08/952,219

[22] PCT Filed: Mar. 20, 1997

[86] PCT No.: PCT/FR97/00488

§ 371 Date: Nov. 21, 1997

§ 102(e) Date: Nov. 21, 1997

[87] PCT Pub. No.: WO97/37733

PCT Pub. Date: Oct. 16, 1997

[30] Foreign Application Priority Data

Apr. 5, 1993 [FR] France ..... 96 04643

[51] Int. Cl.[7] ..... A63C 17/14

[52] U.S. Cl. ..... 280/11.2; 188/5

[58] Field of Search ..... 280/11.2, 11.22, 280/11.19, 11.23; 188/5

[56] References Cited

U.S. PATENT DOCUMENTS

| | | | |
|---|---|---|---|
| 863,675 | 8/1907 | Towle | 280/11.19 |
| 3,112,120 | 11/1963 | Ware | 280/11.2 |
| 4,666,168 | 5/1987 | Hamill et al. | 280/11.2 |
| 4,666,169 | 5/1987 | Hamill et al. | 280/11.23 |
| 5,280,931 | 1/1994 | Horton | 280/11.2 |
| 5,401,038 | 3/1995 | Peck et al. | 280/11.2 |
| 5,441,286 | 8/1995 | Pozzobon | 280/11.27 |
| 5,595,392 | 1/1997 | Casillas | 280/7.13 |
| 5,601,299 | 2/1997 | Yun et al. | 280/87.042 |
| 5,645,287 | 7/1997 | Soo | 280/11.12 |
| 5,655,783 | 8/1997 | Brosnan | 280/11.2 |
| 5,741,017 | 4/1998 | Chen | 280/11.2 |
| 5,882,087 | 3/1999 | Post | 301/5.3 |

FOREIGN PATENT DOCUMENTS

| | | | |
|---|---|---|---|
| 414522 | 2/1991 | European Pat. Off. | 280/11.2 |
| 0603728 | 6/1994 | European Pat. Off. . | |
| 0687487 | 12/1995 | European Pat. Off. . | |
| 2157182 | 10/1985 | United Kingdom . | |

*Primary Examiner*—Paul N. Dickson
*Assistant Examiner*—David R. Dunn
*Attorney, Agent, or Firm*—Greenblum & Bernstein, P.L.C.

[57] ABSTRACT

A braking device for a roller skate, the roller skate including a boot whose sole is associated to an upper plate of a chassis along a lower part of which are located the skating wheels. The braking device includes a friction element arranged on one end of the chassis in proximity to the ground. The friction element is associated to the chassis by a detachable elastic latching mechanism interposed between the element, directly or via the intermediary of a support and the chassis, so as to allow a rapid assembly and disassembly of the friction element without the necessity of a tool.

24 Claims, 4 Drawing Sheets

BRAKING DEVICE FOR ROLLER SKATES

BACKGROUND OF THE INVENTION

1. Field of the Invention

The instant invention is related to a skate of the in-line type comprising a boot whose sole is adapted to be associated to the upper plate of a chassis on which the skating wheels are arranged.

2. Description of Background and Relevant Information

In this type of sport, it soon proved necessary to have a braking device, both in order to fulfill the safety criteria, as well as to enable some artistic or acrobatic figure skating to be executed.

It is with these in mind that a fixed friction element affixed to a rear part of the chassis and capable of coming into contact with the ground by friction is often provided, in order to obtain an efficient braking by a lifting action of the front wheels that is implemented by the skater.

Such a principle naturally leads to wear and tear and the frequent replacement of said friction elements, which results in assembly and disassembly operations that are long and pain-staking, even more so due to the fact that in general, the friction element is affixed on the axle of the rear wheel, and this means that one has to work on the latter element in order to assemble or disassemble the friction element.

In addition, the presence of the latter is essential since the axle of the wheel is designed to take it into consideration. However, it appears that some skaters prefer to retract the friction element in some cases. This cannot be done according to the known embodiments or at any rate, not easily.

Another disadvantage lies in the fact that these braking devices are, in any given model, installed on the skate as soon as they leave the assembly line, resulting in having to handle more substantial volumes of skates, and leading to problems linked to volume requirements both during the storage and packaging of the skates.

In addition, depending on the level of competence and the style of the skater, it is sometimes desirable to be able to vary the maintenance of the friction element on the ground.

However, currently known skates do not allow for this possibility, which is also useful in order to compensate for the wear and tear of the friction material.

SUMMARY OF THE INVENTION

It is an object of the instant invention to overcome the above-cited disadvantages or to achieve the objectives that were discussed.

To this end, it is related to a braking device for a roller skate comprising a chassis on a lower part of which the skating wheels are located, the device including by a friction element located at one end of the chassis in proximity to the ground, wherein the friction element is associated to the chassis by a detachable elastic latching mechanism interposed between the element, directly or via the intermediary of a support and the chassis, so as to allow the rapid assembly and disassembly of the friction element without having to use a tool, and without having to dismantle a wheel axle.

The instant invention is also related to the characteristics that will become apparent from the description that follows, and these should be taken into consideration singly or as per all possible technical combinations thereof.

BRIEF DESCRIPTION OF THE DRAWINGS

This description is provided as a non-restrictive example and will lead to a better understanding of how the invention can be obtained, with reference to the annexed drawings, wherein.

DETAILED DESCRIPTION OF THE INVENTION

Figure 1:
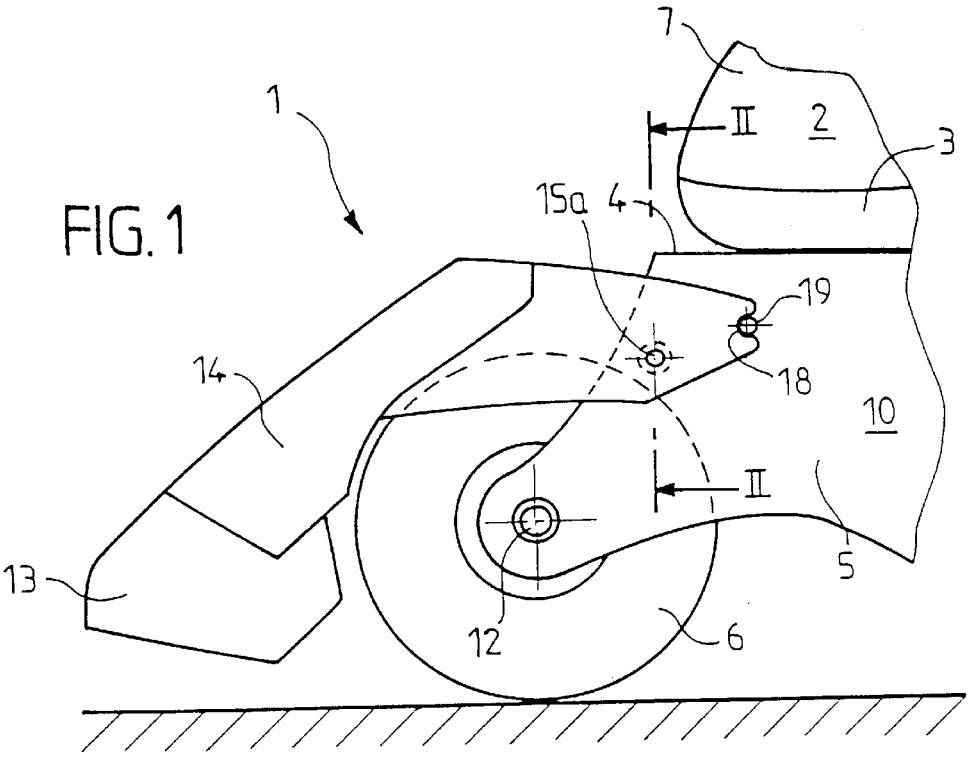
FIG. 1 is a lateral view of a rear portion of an in-line roller skate equipped with a detachable braking device as per the invention.

The in-line roller skate 1, designated in its entirety and partially represented in FIG. 1, comprises a boot 2 constituted of an outer sole 3, adapted to be affixed to the upper plate 4 of a frame or chassis 5 on which are arranged the wheels 6, sole 3 from where an upper 7 extends, the upper covering the entire foot and extending in the direction of the skater's ankle.

The sole 3 of the boot 2 is affixed to the chassis 5 forming the upper horizontal plate 4 on which said sole 3 is affixed by means of affixing means, such as screws that cross the plate 4 to be screwed in the edges of the sole 3.

The chassis 5 also comprises a lower portion, perpendicular to the plate along its longitudinal axis, and it is constituted, for example, by two lateral vertical flange or wings 10*a*, 10*b* that are parallel to one another and located on either side of the longitudinal axis of the chassis. The lateral wings 10*a*, 10*b* respectively are extended at their upper portion by a perpendicular return, each of them being directed towards the inside and constituting a plane corresponding to the horizontal plate 4.

In this manner, the lateral vertical wings 10*a*, 10*b* generally define, with the sole 3 of boot 2, an inverted "U" between the wings of which are located a plurality of wheels 6, for example, four in number, by mechanism of the transverse journal axes 12 affixed to the chassis 4 in order to constitute a rolling train.

The braking device assembly is constituted, on the one hand, by a fixed friction element 13 affixed to a rear part of chassis 5 and capable of coming into contact with the ground by friction in order to provide efficient braking, by a lifting action of the front wheels that is implemented by the skater.

A braking block 13 is fixed on a cap 14 whose two lateral wings 14*a* and 14*b*, forming an "U", are spaced apart in such a way as to be able to cooperate with the wings 10*a*, 10*b* of a chassis 5 by mechanism of a detachable elastic latching means 15*a*, 15*b* that are interposed between the element, directly or via the intermediary of the support 14 and chassis 5 so as to allow a rapid assembly and disassembly, without using a tool, of the friction element 13 or the friction element 13 and cap 14 assembly.

Figure 2A:
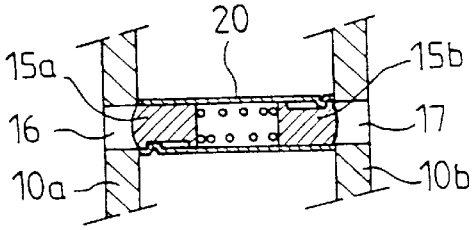
FIGS. 2A, 2B, 2C are detailed sectional views along the line II—II of FIG. 1 representing the latching mechanism, respectively unlatched, during the latching operation and latched on the chassis.
Figure 2B:
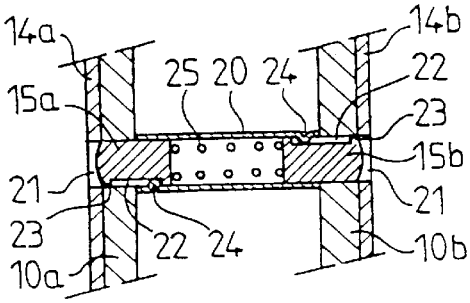
Figure 2C:
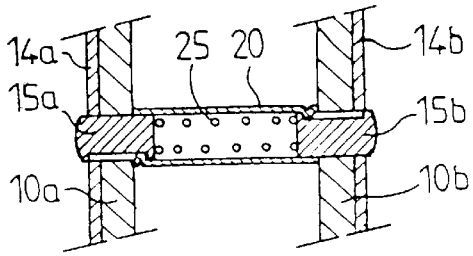

The friction element 13 is mounted on the cap 14 prior to its assembly on the chassis and comprises connecting and indexing mechanism 18 that are associated to the latching mechanism and adapted to cooperate during assembly with the corresponding means 19 of chassis 5. According to a first embodiment of the invention represented in FIGS. 1 and 2, the detachable latching mechanism of the friction skate and cap assembly are constituted of two retractable pins 15*a*, 15*b*, located on either side of the two lateral wings 10*a*, 10*b* of chassis 10, and adapted to cooperate with the housings 16, 17 of the two corresponding lateral wings 14*a*, 14*b* of a cap 14 affixed to the friction element 13, such housings 16, 17 constituting a part of the connecting and indexing mechanism with respect to chassis 5.

Indeed, the indexing of the cap 14, that bears the friction element 13, is done by means of a structural part of the cap 14, in the form of a notch 18 shaped like a fork and arranged at the free end of each of its lateral wings 14*a*, 14*b*, and adapted to cooperate with a corresponding structural part affixed to the chassis, in the form of abutments 19 obtained on either side of the wings 10*a*, 10*b* of the chassis 5.

Preferably, the latching pins 15*a*, 15*b* are constituted by two cylindrical elements having rounded ends and located on either side of the open ends of a corresponding tube 20 in which they are capable of sliding by manual pressure that is exerted against a compression spring 25 interposed there between, such tube 20 being located between the two wings 10*a*, 10*b* of the chassis 5 across from the two passage holes 21 arranged on the cap 14.

As such, the latching pins 15*a*, 15*b* are each biased by the spring 25 outside the tube 20 in order to become engaged in the holes 21 and the associated housings 16, 17 of the cap 14.

Furthermore, the pins 15*a*, 15*b* each comprise a longitudinal sliding groove 22, closed at its longitudinal ends, which thus constitutes retention abutments 23, the groove 22 cooperating by sliding with a fixed tooth 24 obtained within the tube 20, for example, by a crimping operation, and having the effect of retaining the pins 15*a*, 15*b* within the tube, while allowing them a clearance towards the inside and the outside of the tube 20 along a path that corresponds to the length of the groove 22.

Figure 3:
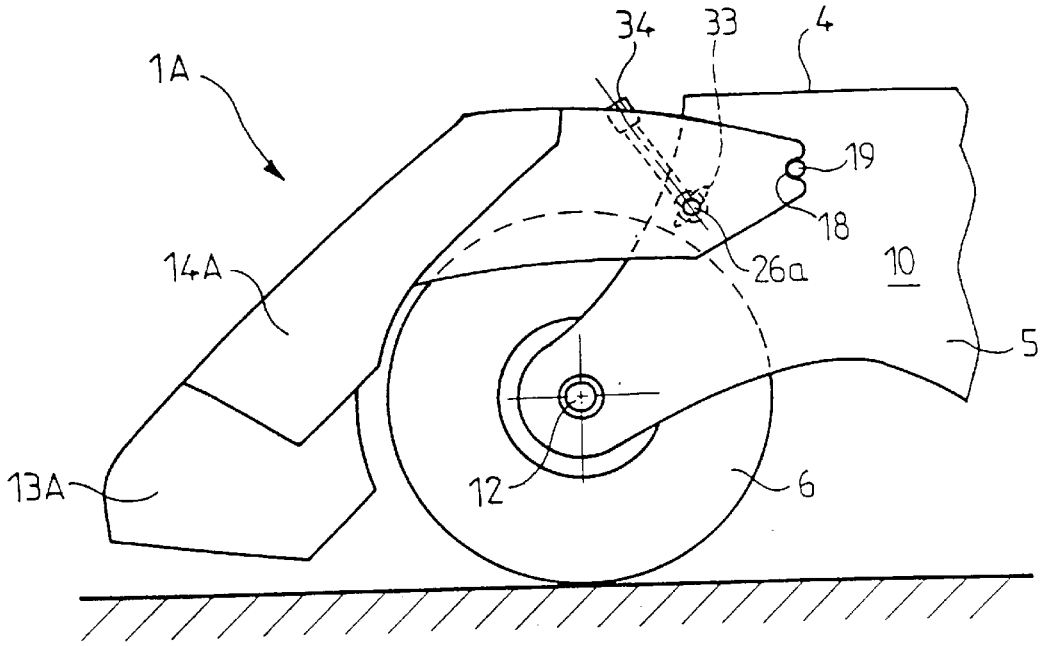
FIG. 3 is a partial lateral view of a skate as per an embodiment of the latching mechanism of the detachable braking device.
Figure 4A:
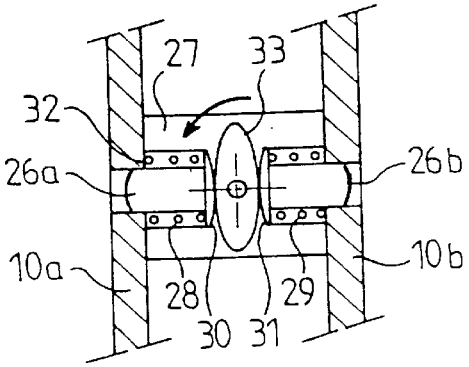
FIGS. 4A and 4B are detailed sectional views of the latching means as per FIG. 3, respectively unlatched and latched on the chassis.
Figure 4B:
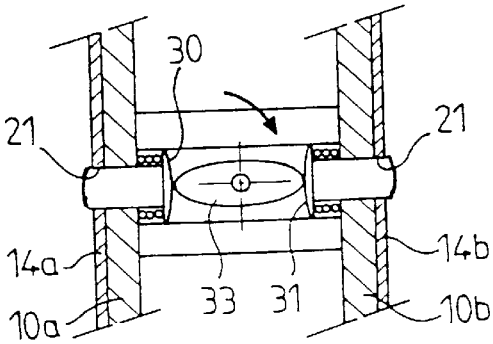

The embodiment of FIGS. 3 and 4 essentially differs from the previous embodiment in that the latching pins 26*a*, 26*b* are constituted of two cylindrical elements arranged on either side of the open ends of a corresponding tube 27 in which each of them is capable of sliding against an associated compression spring 28,29, each being interposed between an inner enlarged head 30, 31 of each pin 26*a*, 26*b*, and an inner face of a corresponding wing 10*a*, 10*b* of the chassis 5, against the periphery of a passage hole 32 of the pins 26*a*, 26*b*, obtained on said wings and across from the passage holes 21 of the cap 14A, the pins 26*a*, 26*b* being simultaneously controlled during latching or during unlatching by a rotational cam 33 interposed between the inner enlarged heads 30, 31 and capable of being actuated from the outside of cap 14A.

As can be seen from FIG. 4, the cam 33 has an elliptical shape and its control means could, for example, be constituted of a control wheel 34 connected to the cam 33 by a shaft 34*a* and acting rotationally on the cam 33 by a quarter of a revolution in one direction or the other.

In both cases, the mounting of the friction skate 13–13A —cap 14–14A assembly is done by the engagement of the notches 18 along the corresponding abutments 19 of the chassis, and the snapping of the respective pins 15*a*, 15*b*, 26*a*, 26*b* in the housings 16, 17 of the cap support 14–14A.

Figure 5:
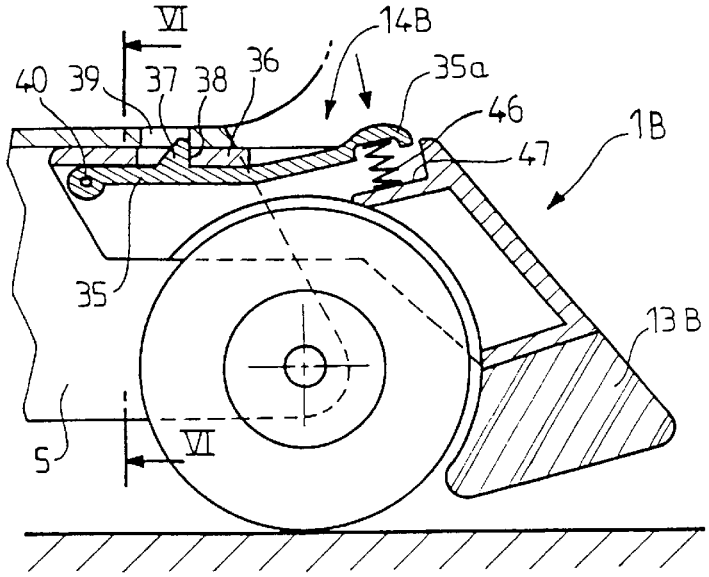
FIG. 5 is a partial lateral view of a skate as per an embodiment of the latching mechanism of the detachable braking device.

According to another embodiment of the invention (FIGS. 5 and 6), the detachable latching mechanism of the friction skate 13B and cap 14B assembly are constituted of an elastic return lever 35 mounted on an axis 40, under the upper dome 36 of a cap 14B affixed to the friction element 13B and comprising a latching notch 37 crossing an upper opening 38 of the dome 36 and capable of cooperating by elastic snapping with a corresponding slot 39 obtained on the upper part of a housing 41 of a chassis 5 corresponding to the cap section 14B of the friction element 13B and constituting the connecting and indexing mechanism with respect to chassis 5.

The housing section 41 of chassis 5 and the cap section 14B of the friction element 13B have a complementary "T" shape so as to make them capable of sliding into one another.

Figure 6:
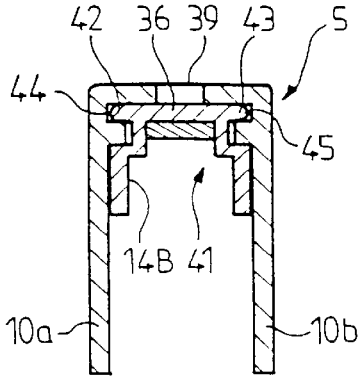
FIG. 6 is a reduced scale, detailed sectional view along the line VI—VI of FIG. 5.

As can be seen well from FIG. 6, the sliding of the cap 14B in the housing 41 of chassis 5 is done by the lateral arms 42, 43 of the "T" formed by the cap 14B, cooperating with the grooves 44 and 45 obtained on the inner faces of the chassis 5.

For the assembly, one only needs to mount the cap 14B in the "T" of the chassis 5, and push until the lever 35 is snapped into the slot 39 of chassis 5, the disassembly being done inversely by exerting pressure on the lever 35 and then by exerting traction on the cap 14B.

According to the present embodiment, the elastic return member of the latching lever 35 is a compression spring 46 interposed between its free end 35*a* opposite its journal point 40 in the cap 14B of the friction element 13B and a corresponding fixed portion 47 of the cap.

Figure 7:
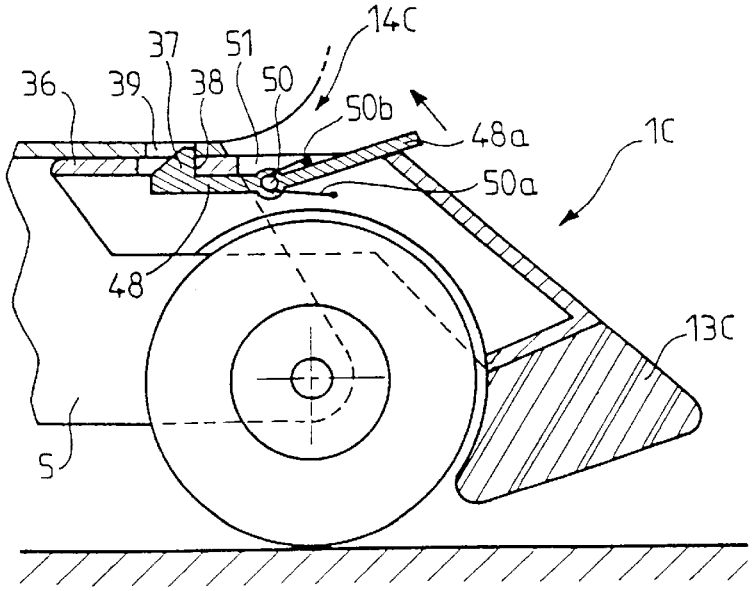
FIG. 7 is a partial lateral view of a skate as per an embodiment of the latching mechanism of the detachable braking device.

The embodiment represented in FIG. 7 essentially differs from the previous embodiment in that the elastic return member of the latching lever 48 is a kickover spring journalled on a central journal point 50 of the lever, one of the free ends 50*a* of the pin being affixed to the cap 14C of the friction element 13C, whereas the other 50*b* is fixed to the lever 48.

The grippable portion 48*a* of the lever can move in a slot 51 of the cap 14B. This clearance is obtained by lifting in order to achieve the unlatching, contrary to the previous embodiment where the unlatching was obtained by pressing.

Figure 8:
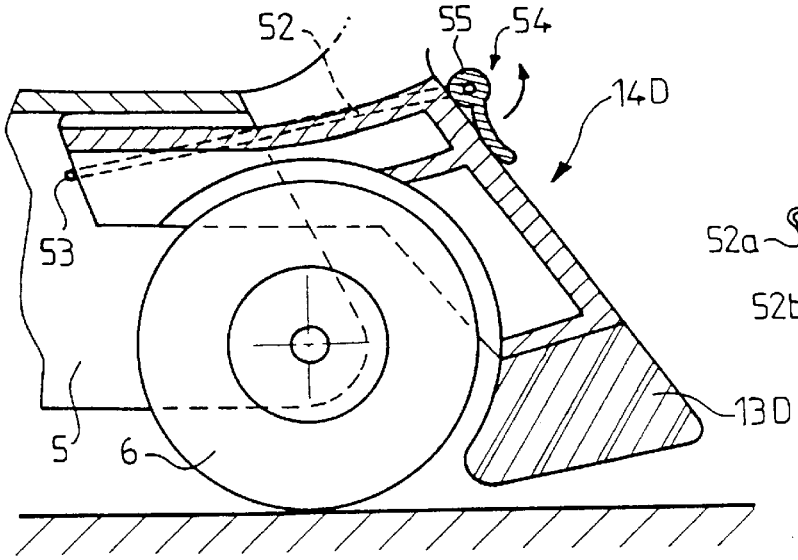
FIG. 8 is a partial lateral view of a skate as per an embodiment of the latching mechanism.
Figure 9:
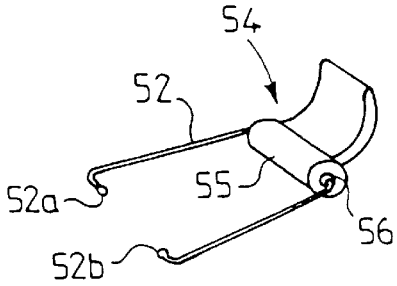
FIG. 9 is an isolated view of a cam constituting the latching mechanism as per FIG. 8.

Another variation of the invention represented in FIGS. 8 and 9 essentially differs from the previous embodiments in that the detachable latching mechanism of the friction element 13D are constituted, on the one hand, by a stirrup 52, constituted in this case of a metal pin shaped like an "U" and journalled on the chassis 5 by means of or recesses 53 with which the free ends 52*a*, 52*b* of the stirrup 52 cooperate. The stirrup is shaped in such a way as to simultaneously envelope a cap 14D affixed to the friction element 13D and a rear portion of the chassis 5, in a housing of which the cap 14D is positioned in order to constitute the connecting and indexing mechanism with respect to the chassis 5. On the other hand, the latching mechanism comprises a cam-lever 54 constituted by a cylinder 55 equipped with a longitudinal hole 56 that is off-centered with respect to its axis and crossed by an arm of the stirrup 52 opposite its journal 53, such that a rotation exerted on the cam 54, previously placed in support on the cap 14D that bears the friction element 13D, or directly thereupon, causes the latter element to exert pressure against the chassis 5.

Figure 10:
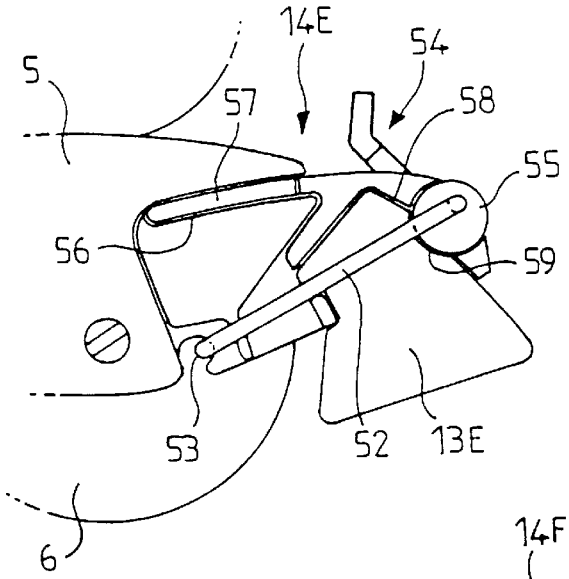
FIG. 10 is a partial lateral view of a skate equipped with latching mechanism as per the principle of FIG. 8, but also simultaneously ensuring the affixing of the braking device and the friction element that it comprises.
Figure 11:
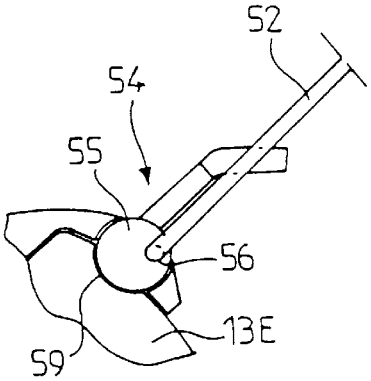
FIG. 11 is a detailed view of the latching mechanism as per FIG. 10, in the unlatched position.

According to the embodiment of FIGS. 10 and 11, the cap 14E comprises, on the one hand, in a front portion, slides 56 that cooperate with complementary grooves 57 of the rear portion of the chassis 5 so as to ensure its connection and indexing, and on the other hand, in a rear portion, a housing 58 intended for the insertion of the friction element 13E, the housing 58 being equipped with a longitudinal slot 59 ensuring both the positioning of the cam-lever 54 on the cap 14E and the retention of the friction element 13E therein.

Furthermore, the stirrup 52 is designed so as to envelop and surround not only the cap 14E and the rear portion of the chassis, but also the friction element 13F.

Figure 12:
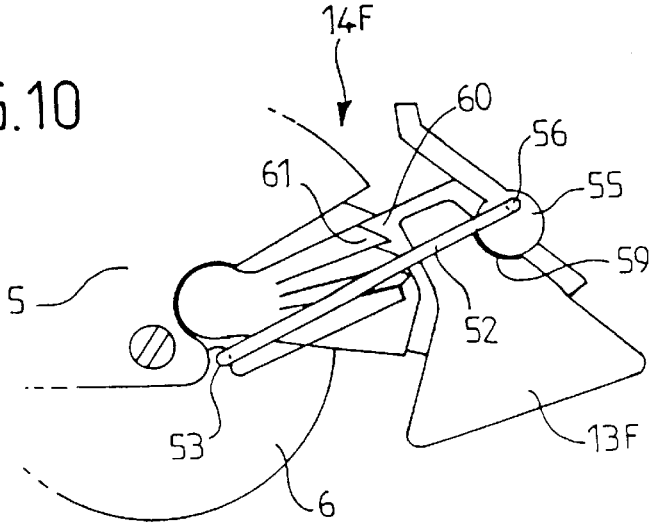
FIG. 12 is a partial lateral view of a skate equipped with a latching mechanism as per the principle of FIG. 10, but also comprising the adjustment mechanism for its maintenance on the ground.

The embodiment of FIG. 12 also differs from the previous embodiment in that the cap 14F comprises mechanism for adjusting the height of the friction element 13F, thence its retention on the ground, such means being constituted of a plurality of transverse notches 60 obtained on an inner base wall of the cap with which such notches 60 are capable of cooperating, at least one corresponding notch 61 being obtained on a rear portion of the chassis 5.

The major advantage obtained by the embodiments of FIGS. 10, 11 and 12 is that they allow the latching and unlatching of both the cap with respect to the chassis, and the friction element with respect to the cap, thus facilitating the replacement of either one or the other, or both at the same time.

What is claimed is:

1. A roller skate comprising:

a frame having a lower part comprising a pair of spaced apart flanges;

a plurality of skating wheels, each of said skating wheels being secured between said flanges to said frame by mechanism of respective axles;

a braking device comprising:

a friction element arranged on one end of said frame in proximity to the ground;

a detachable elastic latching mechanism connecting said friction element to said frame and facilitating a rapid assembly and disassembly of said friction element to and from said frame without necessitating use of a tool, said detachable elastic latching mechanism comprising:

at least one latching member;

an elastic element imposing an elastic biasing force to move said latching member to a latched position, thereby latching said friction element to said frame;

said at least one latching member having a manipulatable portion to facilitate the exertion of a force opposing said elastic biasing force to move said latching member to an unlatched position and, thereby unlatching said friction element with respect to said frame.

2. A roller skate according to claim 1, wherein:

said latching member is positioned independent of said axles of said skating wheels.

3. A roller skate according to claim 1, further comprising:

a support;

wherein said friction element is fixedly secured to said support, said detachable elastic latching mechanism engaging said support to said frame, thereby connecting said friction element to said frame.

4. A roller skate according to claim 3, further comprising:

a connecting and indexing mechanism associated with said latching mechanism, said connecting and indexing mechanism comprising a structural part of said support, said structural part of said support cooperating during assembly of the roller skate with a corresponding structural part of said frame.

5. A roller skate according to claim 3, wherein:

said support comprises a cap having a pair of lateral wings, each of said wings of said cap including a respective housing, said housings comprising a part of said connecting and indexing mechanism;

said at least one latching member of said detachable latching mechanism comprises two elastically biased pins, each of said pins being biased by an elastic element to a latched position into a respective one of said housings, thereby securing said cap to a respective one of said flanges of said frame.

6. A roller skate according to claim 5, wherein:

said lateral wings of said cap are spaced apart a distance for cooperation with said flanges of said frame;

each of said wings of said cap further includes a free end, with a respective notch being formed in each of said free ends;

each of said flanges of said frame includes corresponding abutments, said notches of said wings of said cap being engaged with respective ones of said abutments of said flanges of said frame.

7. A roller skate according to claim 5, wherein:

each of said two elastically biased pins has a cylindrical shape;

said detachable latching mechanism further comprises a tube having open ends;

said elastic element comprises a compression spring positioned within said tube;

said pins are positioned within said tube on opposite sides of said spring and are adapted to slide within said tube against an elastic bias of said spring;

said tube extends between and through said flanges of said frame adjacent said housings of said cap, whereby said pins are adapted to project into said housings of said cap, against said elastic bias of said spring, thereby securing said cap to said frame.

8. A roller skate according to claim 7, wherein:

each of said pins comprises a longitudinal sliding groove equipped with two retention abutments at opposite ends of said groove, said groove cooperating by sliding with a fixed tooth obtained within said tube so as to retain said pins therein, while also allowing a clearance along a path corresponding to a length of said groove.

9. A roller skate according to claim 1, wherein:

said friction element is fixedly secured to a support, said detachable elastic latching mechanism engaging said support to said frame, thereby connecting said friction element to said frame, said support comprising a cap having a pair of lateral wings, each of said wings of said cap including a respective housing, said housings comprising a part of said connecting and indexing mechanism;

said detachable latching mechanism further comprises a tube having open ends;

said at least one latching member of said detachable elastic latching mechanism comprises two pins, each of said two elastically biased pins having a cylindrical portion and an enlarged head;

respective compression springs positioned around said cylindrical portions of said pins;

said cylindrical portions of said pins extend through respective ones of said flanges of said frame adjacent said housings of said cap, whereby said pins are adapted to project into said housings of said cap, against said elastic bias of said compression springs;

a cam interposed in engagement between said enlarged heads of said two pins within said tube, said cam controlling latching and unlatching of said cap to and from said frame.

10. A roller skate according to claim 1, wherein:

said at least one latching member of said detachable elastic latching mechanism comprises an elastic return lever located on a journal, beneath an upper dome of a cap affixed to said friction element and comprising a latching notch extending through an upper opening of said dome and adapted to cooperate, by elastic snapping, with a corresponding slot formed at an upper portion of a housing of said frame corresponding to said cap section of said friction element and constituting a connecting and indexing mechanism with respect to said frame.

11. A roller skate according to claim 10, wherein:

said housing of said frame and said cap of said friction element are T-shaped for enabling sliding with respect to each another.

12. A roller skate according to claim 10, wherein:

said elastic element is a compression spring interposed between a free end of said return lever opposite said journal and a corresponding fixed portion of said cap.

13. A roller skate according to claim 10, wherein:

said elastic element is a kickover spring journalled at a central journal point of said lever, said spring having a pair of free ends, one of said free ends being affixed to said cap and a second of said free ends is fixed.

14. A roller skate according to claim 1, wherein:

said detachable elastic latching mechanism comprises:

a stirrup journalled on said frame via free ends of said stirrup being positioned in recesses in said frame, said stirrup being adapted to simultaneously envelop a cap affixed to said friction element and a rear portion of said frame, said frame having a housing, said cap being positioned in said housing so as to constitute a connecting and indexing mechanism with respect to said frame; and a cam-lever comprising a cylinder equipped with a longitudinally extending opening, said opening having an off-centered axis and an arm of the stirrup extending through said opening opposite the journal of said stirrup, whereby rotation exerted on said cam causes said cap and friction element to be pressured against said frame.

15. A roller skate according to claim 14, wherein:

said cap comprises, in a front portion, slides cooperating with complementary grooves of a rear portion of said frame so as to ensure connection and indexing;

said cap further comprises, in a rear portion, a housing adapted for insertion of said friction element, said housing being equipped with a longitudinal slot both ensuring positioning of said cam-lever on said cap and maintenance therein of said friction element.

16. A roller skate according to claim 14, wherein:

said cap comprises mechanism for adjusting the height of said friction element and, thereby, retention of said friction element on the ground, said mechanism comprising a plurality of transverse notches provided along an inner base wall of said cap with which said notches are capable of cooperating, at least one corresponding notch being provided along a rear portion of said frame.

17. A roller skate comprising:

a frame having a lower part comprising a pair of spaced apart flanges;

a plurality of skating wheels, each of said skating wheels being secured between said flanges to said frame by mechanism of respective axles;

a braking device comprising:

a friction element arranged on one end of said frame in proximity to the ground;

a detachable elastic latching mechanism connecting said friction element to said frame and facilitating a rapid assembly and disassembly of said friction element to and from said frame without necessitating use of a tool, said detachable elastic latching mechanism comprising at least two fixing elements, each of said two fixing elements being adapted to be detachably fixed to respective ones of said flanges of said frame, independent of said axles of said skating wheels.

18. A roller skate according to claim 17 further comprising:

a support;

wherein said friction element is fixedly secured to said support, said detachable elastic latching mechanism engaging said support to said frame, thereby connecting said friction element to said frame.

19. A roller skate according to claim 18, further comprising:

a connecting and indexing mechanism associated with said latching mechanism, said connecting and indexing mechanism comprising a structural part of said support, said structural part of said support cooperating during assembly of the roller skate with a corresponding structural part of said frame.

20. A roller skate according to claim 18, wherein:

said support comprises a cap having a pair of lateral wings, each of said wings of said cap including a respective housing, said housings comprising a part of said connecting and indexing mechanism;

said detachable latching mechanism comprises two elastically biased pins, each of said pins being biased by an elastic element to a latched position into a respective one of said housings, thereby securing said cap to a respective one of said flanges of said frame.

21. A roller skate according to claim 20, wherein:

said lateral wings of said cap are spaced apart a distance for cooperation with said flanges of said frame;

each of said wings of said cap further includes a free end, with a respective notch being formed in each of said free ends;

each of said flanges of said frame includes corresponding abutments, said notches of said wings of said cap being engaged with respective ones of said abutments of said flanges of said frame.

22. A roller skate according to claim 20, wherein:

each of said two elastically biased pins has a cylindrical shape;

said detachable latching mechanism further comprises a tube having open ends;

said elastic element comprises a compression spring positioned within said tube;

said pins are positioned within said tube on opposite sides of said spring and are adapted to slide within said tube against an elastic bias of said spring;

said tube extends between and through said flanges of said frame adjacent said housings of said cap, whereby said pins are adapted to project into said housings of said cap, against said elastic bias of said spring, thereby securing said cap to said frame.

23. A roller skate according to claim 22, wherein:

each of said pins comprises a longitudinal sliding groove equipped with two retention abutments at opposite ends of said groove, said groove cooperating by sliding with a fixed tooth obtained within said tube so as to retain said pins therein, while also allowing a clearance along a path corresponding to a length of said groove.

24. A roller skate according to claim 17, wherein:

said friction element is fixedly secured to a support, said detachable elastic latching mechanism engaging said support to said frame, thereby connecting said friction element to said frame, said support comprising a cap having a pair of lateral wings, each of said wings of said cap including a respective housing, said housings comprising a part of said connecting and indexing mechanism;

said detachable latching mechanism further comprises a tube having open ends;

said elastic latching mechanism comprises two pins, each of said two elastically biased pins having a cylindrical portion and an enlarged head;

respective compression springs positioned around said cylindrical portions of said pins;

said cylindrical portions of said pins extend through respective ones of said flanges of said frame adjacent said housings of said cap, whereby said pins are adapted to project into said housings of said cap, against said elastic bias of said compression springs;

a cam interposed in engagement between said enlarged heads of said two pins within said tube, said cam controlling latching and unlatching of said cap to and from said frame.

* * * * *